US007118432B2

(12) United States Patent
Katayama

(10) Patent No.: US 7,118,432 B2
(45) Date of Patent: Oct. 10, 2006

(54) OUTBOARD MOTOR WITH COWLING

(75) Inventor: Goichi Katayama, Hamamatsu (JP)

(73) Assignee: Yamaha Marine Kabushiki Kaisha, (JP)

( * ) Notice: Subject to any disclaimer, the term of this patent is extended or adjusted under 35 U.S.C. 154(b) by 0 days.

(21) Appl. No.: 10/814,416

(22) Filed: Mar. 31, 2004

(65) Prior Publication Data

US 2005/0079775 A1 Apr. 14, 2005

(30) Foreign Application Priority Data

Mar. 31, 2003 (JP) ..... 2003-093101

(51) Int. Cl.
*B63H 21/36* (2006.01)

(52) U.S. Cl. ..... 440/77

(58) Field of Classification Search ..... 440/77
See application file for complete search history.

(56) References Cited

U.S. PATENT DOCUMENTS 4,379,702 A * 4/1983 Takada et al. ..... 440/77
4,522,602 A * 6/1985 Okazaki ..... 440/77
4,952,180 A 8/1990 Watanabe et al. ..... 440/77
4,968,276 A 11/1990 Hashimoto ..... 440/77
5,069,644 A 12/1991 Kobayashi et al. ..... 440/77
5,277,633 A 1/1994 Kato et al. ..... 440/77
5,340,343 A 8/1994 Kawamukai et al. ..... 440/88
5,360,358 A * 11/1994 Haman ..... 440/77
5,445,547 A * 8/1995 Furukawa ..... 440/77
5,713,772 A 2/1998 Takahashi et al. ..... 440/78
5,873,755 A 2/1999 Takahashi et al. ..... 440/77
5,899,778 A 5/1999 Hiraoka et al. ..... 440/88
6,099,371 A * 8/2000 Nozawa et al. ..... 440/77
6,296,536 B1 10/2001 Katayama et al. ..... 440/77

FOREIGN PATENT DOCUMENTS

JP 10-7087 1/1998

* cited by examiner

*Primary Examiner*—Sherman Basinger
(74) *Attorney, Agent, or Firm*—Knobbe, Martens, Olson & Bear LLP

(57) ABSTRACT

An outboard has a housing unit mounted on an associated watercraft. An engine is disposed on the housing unit. A cowling surrounds the engine. The cowling has an inlet port through which atmospheric air enters inside of the cowling. At least a substantial portion of the cowling is made of a nonferrous metal.

29 Claims, 8 Drawing Sheets

OUTBOARD MOTOR WITH COWLING

PRIORITY INFORMATION

This application is based on and claims priority under 35 U.S.C. § 119 to Japanese Patent Application No. 2003-093101, filed Mar. 31, 2003, the entire contents of which is hereby expressly incorporated by reference.

BACKGROUND

1. Field of the Art

The present invention generally relates to an outboard motor with a cowling, and more particularly relates to an outboard motor that has a cowling enclosing an engine therein.

2. Description of Related Art

An outboard motor typically comprises a housing unit that can be mounted on an associated watercraft. An internal combustion engine is disposed above the housing unit. Typically, a propeller is journaled on a lower part of the housing unit. The engine powers the propeller through a driveshaft and a propeller shaft both extending through the housing unit. In order to protect the engine from objects and water, a cowling surrounds the engine.

The cowling defines a generally closed cavity around the engine. The cowling has an air inlet port through which the atmospheric air enters the cavity. The engine draws the air into one or more combustion chambers to burn fuel which is also delivered into the combustion chambers. Relatively cool air is preferable for the engine because the cool air can make the charging efficiency better and, as a result, can improve the output of the engine.

Typically, the cowling is made of a plastic material. Because such a plastic cowling has in sufficient heat radiation and engines normally build heat while operating, the air in the cavity can become warm, deteriorating the charging efficiency of the engine.

SUMMARY OF THE INVENTION

In order to resolve the foregoing problem, the engine can have an air intake system that directly introduces the atmospheric air into the combustion chambers without having the air flow through the internal cavity of the cowling. This construction, however, may cause other problems such as water being drawn into the combustion chambers together with the air. A need therefore exists for a cowling for an outboard motor that can provide relatively cool air to an engine without allowing water to be drawn into the engine together with air.

An aspect of the present invention involves an outboard motor that comprises a housing unit adapted to be mounted on an associated watercraft. An internal combustion engine is disposed on the housing unit. A cowling surrounds the engine. The cowling has a first inlet port through which atmospheric air enters inside the cowling. The cowling substantially is made of a nonferrous metal.

In accordance with another aspect of the present invention, an outboard motor comprises an internal combustion engine. A cowling surrounds the engine. The cowling comprises an external wall portion and an internal wall portion together defining an airflow space through which atmospheric air flows. At least one of external or internal wall portions has at least one cooling fin that projects into the airflow space.

In accordance with a further aspect of the present invention, an outboard motor comprises an internal combustion engine. A cowling surrounds the engine. The cowling comprises a top cowling member and a bottom cowling member. The engine is disposed primarily above the bottom cowling. The top cowling member is detachably affixed to the bottom cowling member. The engine has an air intake device. The cowling comprises an external wall portion and an internal wall portion together defining an airflow space through which air flows. The airflow space is coupled to the air intake device when the top cowling member is attached to the bottom cowling member.

In accordance with a further aspect of the present invention, a cowling for an outboard motor that has an internal combustion engine comprises a body that is adapted to surround the engine. The body has an opening through which the engine is capable to pass. The body is made of a nonferrous metal.

BRIEF DESCRIPTION OF THE DRAWINGS

These and other features, aspects and advantages of the present invention are now described with reference to the drawings of preferred embodiments, which embodiments are intended to illustrate and not to limit the present inventions. The drawings comprise eight figures in which.

DETAILED DESCRIPTION OF PREFERRED EMBODIMENTS OF THE PRESENT INVENTION

Figure 1:
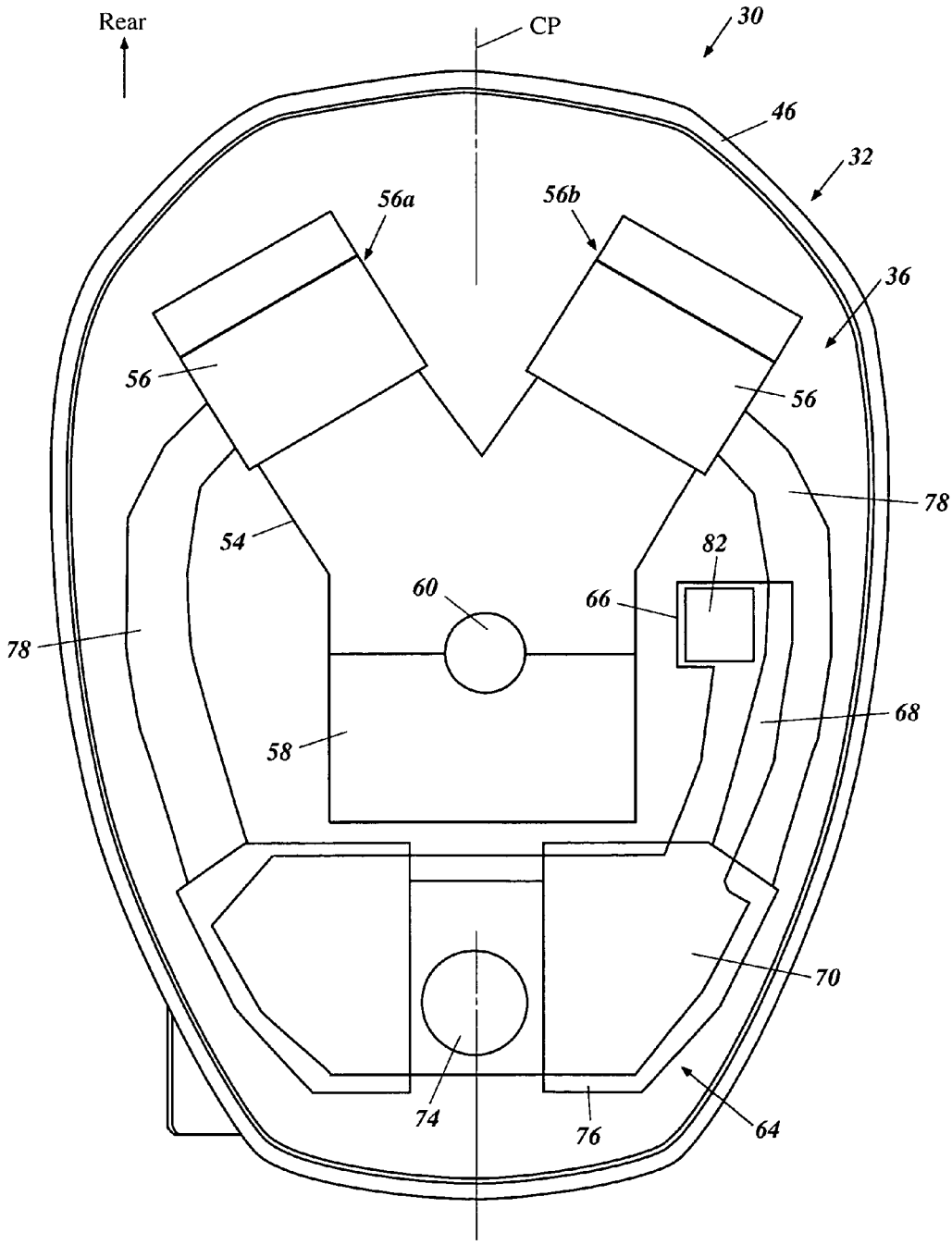
FIG. 1 schematically illustrates a top plan view of an outboard motor arranged and configured in accordance with certain features, aspects and advantages of the present invention, a top cowling of the outboard motor being removed to show an arrangement of an engine with an air intake system.

With reference to FIGS. 1–4, an overall construction of an outboard motor 30 arranged and configured in accordance with a certain features, aspects and advantages is described. The figures only illustrate a top part of the outboard motor 30, particularly, a power head 32 thereof. A lower part of the outboard motor 30 is similar to a lower part of conventional outboard motors. For example, U.S. Pat. No. 6,296,536 discloses a lower part of a conventional outboard motor, the entire contents of which is hereby expressly incorporated by reference.

The outboard motor 30 preferably comprises a drive unit and a bracket assembly. The bracket assembly supports the drive unit on a transom of an associated watercraft and places a marine propulsion device such as, for example, a propeller in a submerged position with the watercraft resting relative to a surface of a body of water. The drive unit can tilt up and down relative to the watercraft by a tilt mechanism combined with the bracket assembly.

The drive unit preferably comprises the power head 32 and a housing unit 34. The power head 32 is disposed atop the drive unit and includes an internal combustion engine 36. In order to protect the engine 36 from objects and water, the power head 32 also includes a protective cowling assembly 38 that surrounds the engine 36. Preferably, the cowling assembly 38 defines a generally closed cavity 40 in which the engine 36 is disposed. The illustrated protective cowling assembly 38 comprises a top cowling 44 and a bottom cowling 46. Preferably, the top cowling 44 is detachably affixed to the bottom cowling member 46 by a coupling mechanism so that a user, operator, mechanic or repairperson can access the engine 36 for maintenance or for other purposes. The illustrated top cowling 44 can be attached and detached in a vertical direction.

The top cowling 64 preferably has an air inlet port 48 and an air duct 50 disposed on a side opposite to the bracket assembly. The atmospheric air is drawn into the closed cavity 40 through the inlet port 48 and then through the air duct 50. Preferably, the top cowling 44 tapers in girth toward its top surface, which is in the general proximity of the air inlet port 48.

As used through this description, the terms "rear," "reverse," "backwardly" and "rearwardly" mean at or to the side where the air inlet port 48 is located, and the terms "forward," "forwardly" and "front" mean at or to the opposite side of the rear side, unless indicated otherwise or otherwise readily apparent from the context use.

The bottom cowling 46 preferably has an opening at its bottom portion through which a top portion of the housing unit 34 extends. The bottom cowling 46 and the top portion of the housing unit 34 together form a tray. The engine 36 is placed onto the tray and is affixed to the top portion of the housing unit 34. That is, the housing unit 34 supports the engine 36 thereon.

The engine 36 in the illustrated embodiment is a V-configured, six cylinder engine and preferably operates on a four-cycle combustion principle. This type of engine, however, merely exemplifies one type of engine. Engines having other numbers of cylinders, having other cylinder arrangements, and operating on other combustion principles (e.g., crankcase compression two-stroke or rotary) also can be employed.

The engine 36 preferably comprises a cylinder block 54 that defines six cylinder bores extending horizontally. The cylinder block 54 is bifurcated rearward in a V-configuration to form a pair of banks 56*a*, 56*b*. Each bank 56*a*, 56*b* has three cylinder bores. Pistons are reciprocally disposed in the cylinder bores. A cylinder head 56 is affixed to an end of each bank 56*a*, 56*b*. The cylinder bores, the pistons and the cylinder head 56 together define combustion chambers in which air/fuel charges or mixtures burn.

A crankcase 58 is affixed to another end of the cylinder block 54 to define a crankcase chamber therebetween. A crankshaft 60 preferably is journaled between the cylinder block 54 and the crankcase 58. The crankshaft 60 is coupled with the pistons through connecting rods and rotates with the reciprocal movement of the pistons.

An axis of the crankshaft 60 preferably is positioned on a longitudinal center plane CP that extends vertically and fore to aft of the outboard motor 30. The engine 36 is generally symmetrically arranged relative to the center plane CP.

A driveshaft coupled with the crankshaft 60 preferably extends vertically through the housing unit 34. The housing unit 34 journals the driveshaft for rotation and the crankshaft 60 drives the driveshaft. The housing unit 34 also journals a propulsion shaft for rotation. The propulsion shaft 60 preferably extends generally horizontally through a bottom portion of the housing unit 34. The driveshaft and the propulsion shaft preferably oriented normal to each other (e.g., the rotation axis of propulsion shaft is at 90° to the rotation axis of the driveshaft).

The propulsion shaft drives the propeller through a transmission. A shift mechanism associated with the transmission changes positions of the transmission. The propeller changes among forward, reverse and neutral modes in accordance with the positions of the transmission.

The engine 36 preferably has an air intake system 64 that draws the air in the cavity 40 and delivers the air to the combustion chambers. In the illustrated embodiment, the intake system 64 comprises a vertically extending air delivery duct 66, a horizontally extending air delivery duct 68, an intake silencer 70, a connecting conduit 72, a throttle body 74, a plenum chamber member 76 and a plurality of intake conduits 78.

As used in this description, the term "horizontally" means that the subject portions, members or components extend generally in parallel to the surface of the water body when the watercraft is substantially stationary with respect to the water body and when the drive unit is not tilted either up or down. The term "vertically" in turn means that portions, members or components extend generally normal to those that extend horizontally.

The vertical and horizontal air delivery ducts 66, 68 preferably extend along a side surface of the engine 36 on the port side of the engine 36, although those ducts 66, 68 can extend on the starboard side. The vertical delivery duct 66 extends generally vertically along the engine 36. The vertical delivery duct 66 has an inlet opening 82 at a bottom end thereof. The horizontal delivery duct 68 is coupled with the vertical delivery duct 66 and extends generally in a horizontally forward direction.

The intake silencer 70 is an air intake device that reduces intake noise. The illustrated intake silencer 70 is disposed in front of a top portion of the engine 36. The horizontal delivery duct 68 is coupled to an inlet of the intake silencer 70. The connecting conduit 72 is coupled to an outlet of the intake silencer 70, which is located at a bottom of the intake silencer 70, and extends generally vertically downward from the intake silencer 70.

The throttle body 74 preferably is disposed between the connecting conduit 72 and the plenum chamber member 76. That is, an inlet port 84 of the throttle body 74 is coupled to a bottom end of the connecting conduit 72, while an outlet port 84 of the throttle body 74 is coupled to an inlet opening of the plenum chamber member 76. The throttle body 74 also is positioned generally on the center plane CP. The throttle body 74 preferably journals a butterfly type throttle valve 88 for pivotal movement. Other types of throttle valves such as, for example, a slide type throttle valve can replace the butterfly type throttle valve 88. The throttle valve 88 is operable to change positions or open degree thereof between a substantially fully closed position and a fully open position by the human operator through a conventional throttle valve linkage. The throttle valve 88 measures or regulates an amount of air that flows-through the air intake system 64 toward the combustion chambers. Normally, the greater the open degree, the higher the rate of airflow and the higher the engine speed.

The illustrated plenum chamber member 76 preferably is disposed in front of the engine 36 and below the intake silencer 70. The illustrated plenum chamber member 76 defines a pair of voluminous chambers on both sides of the throttle body 74 to coordinate or smooth the air toward the respective banks 56*a*, 56*b*.

The air intake conduits 78 are disposed between the plenum chamber member 76 and each cylinder head 56 of the banks 56*a*, 56*b*. Preferably, three intake conduits 78 extend generally horizontally along a side surface of the engine 36 on the port side. The foregoing vertical air delivery duct 66 extends between the intake conduits 78 on this side and the side surface of the engine 36. Also, three other intake conduits 78 extend generally horizontally along another side surface of the engine 36 on the starboard side. Each intake conduit 78 defines an external air intake passage that is connected to each internal intake passage defined in the cylinder head 56 and communicating with each combustion chamber.

The engine 36 preferably has a charge former such as, for example, a fuel injection system or a carburetor system that delivers fuel normally stored in a fuel tank to the combustion chambers and mixes air/fuel charges therein. The engine 36 also has an ignition or firing system that has spark plugs exposed into the combustion chambers. The spark plugs ignites the air/fuel charges in the combustion chambers at proper time. Abrupt expansion of the volume of the air/fuel charges, which burn in the combustion chambers, moves the pistons to rotate the crankshaft 60. The engine 36 preferably has an exhaust system that routes exhaust gases, i.e., burnt charges, in the combustion chambers to an external location of the outboard motor 30. The exhaust system has internal sections within the housing unit 34. Preferably, the exhaust gases are discharged under the water through a hub of the propeller or above the water through an idle discharge opening formed on a surface of the housing unit 34.

A flywheel assembly 90 preferably is disposed atop the crankshaft 60. The flywheel assembly 90 is projected upward from a top surface of the engine 36. Preferably, the flywheel assembly 90 forms a flywheel magneto that generates electric power which is supplied to electric components of the outboard motor 30 directly or indirectly via batteries. The flywheel magneto preferably comprises a rotor driven by the crankshaft 36 and a stator that is affixed to a portion of the engine 36.

With continued reference to FIGS. 1–4, the protective cowling assembly 38, particularly, the top cowling 44 is described in greater detail below.

The top cowling 44 in the preferred embodiment comprises a body 44*a* and an external member 44*b*, both of which preferably are made of nonferrous metal as discussed below. The body 44*a* forms a major part of the top cowling 44 and has a front, rear and lateral side sections, all of which are indicated by the reference numeral 94, and a top section 96. In this description, the term "side section" represents the front and rear sections as well as the lateral side sections unless depicted otherwise or otherwise readily apparent from the context use.

Preferably, the body 44*a* is a single member, and the side sections 94 and the top section 96 are unitarily formed with each other. In one variation, the body 44*a* can be formed with a plurality of separate pieces. For instance, a member defining the top section 96 and a member defining the side sections 94 are separately made and then are joined together by, for example, welding. For example, a friction stir welding method can be used. A rotary tool moves along portions that need to be welded in this method. The rotary tool can give proper friction to the portions. The side and top sections 94, 96 are easily and reliably welded with each other with relatively low power consumption by this method. Preferably, the welded portions are located under the external member 44*b* as marked "x" in FIG. 4, because the external member 44*b* keeps the welded portions from sight.

The external member 44*b* preferably is formed separately from the body 44*a* and is affixed to the body 44*a* to generally extend over the top section 96 of the body 44*a*. An airflow space 97 is defined between the top section 96 of the body 44*a* and a bottom surface of the external member 44*b*. The airflow space 97 exists inside of the cowling assembly 38 as well as the closed cavity 40. The external member 44*b* also extends downward on both lateral sides thereof to merge or overlap with a top area of each lateral side section 94 of the body 44*a*. Because the external member 44*b* extends over the top section 96 of the body 44*a*, the external member 44*b* forms an external wall portion and the top section 96 of the body 44*a* forms an internal wall portion in this embodiment. The rear air inlet port 48 is formed between the body 44*a* and the external member 44*b* such that the atmospheric air can enter the airflow space 97. Preferably, the rear inlet port 48 extends generally fully transversely in the most rear end of the top cowling 44.

In the illustrated embodiment, the cowling body 44*a* is made of a nonferrous metal as noted above. The nonferrous metal preferably includes aluminum or magnesium as a component, although other materials can be added. That is, aluminum, aluminum alloy, magnesium or magnesium alloy are preferred. Those nonferrous metals are light and can easily radiate heat before accumulating in the metals. Also, the nonferrous metals have good heat conductivity. Other nonferrous metals of course can be used.

The external member 44*b* and the bottom cowling 46 preferably are made of the same or a different nonferrous metal. In some alternatives, the external member 44*b* and the bottom cowling 46 can be made of another kind of metal or a plastic or resin-based material.

The body 44*a*, the external member 44*b* and the bottom cowling 46 in the illustrated embodiment are formed in a molding process. A die-casting process can be the most preferable process. Preferably, the external member 44*b* is welded to the lateral sides 94 of the body 44*a* in the overlapped area or is affixed thereto by other fixing constructions using, for example, bolts and nuts.

In one variation, if the body 44*a* is formed with separate top and side members as discussed above, sheet metal produced in a press process can be used to form the side members instead of using molded members.

The top section 96 extends generally horizontally and forms the air duct 50 in the rear portion thereof. The air inlet duct 50 preferably is positioned on the longitudinal center plane CP. The air duct 50 extends generally upward and has an inlet opening 98 at its top end and also has an outlet opening 100 at its bottom end. Thus, the atmospheric air can enter the cavity 40 through the air duct 50. The illustrated air duct 50 is gradually cut away forwardly and downwardly from a rear wall portion 102 of the duct 50. In other words, the rear wall portion 102 faces the rear air inlet port 48 to separate water from the air entering the inlet port 48 so as to prevent the water from being drawn into the cavity 40. Also, the rear wall portion 102 preferably acts as a stay or bracket to support a rear portion of the external member 44*b*.

Figure 3:
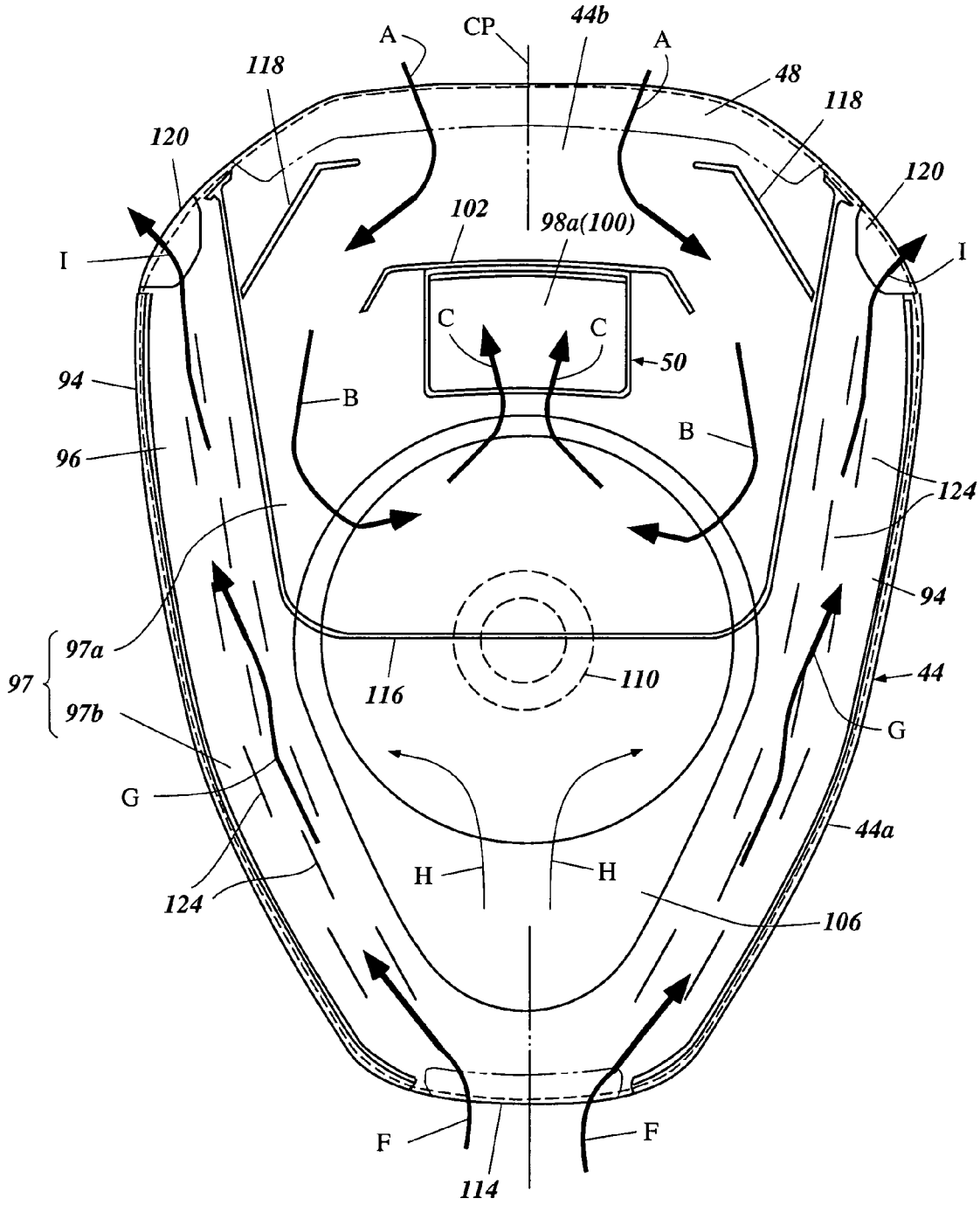
FIG. 3 schematically illustrates a top plan and cross-sectional view of the top cowling, showing a structure under an external member of the top cowling.
Figure 4:
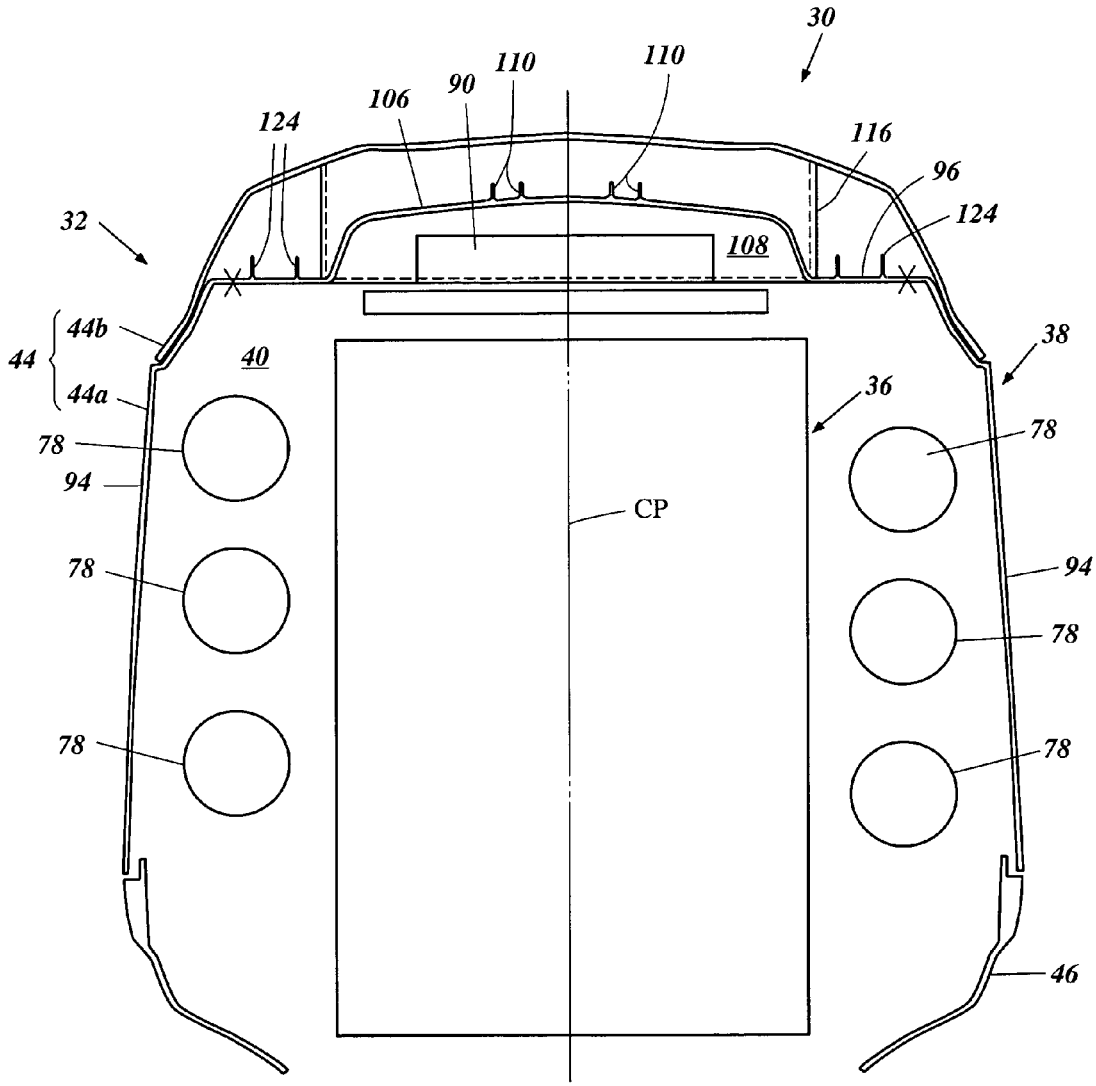
FIG. 4 schematically illustrates a front elevation and cross-sectional view of the top part of the outboard motor.
Figure 5:
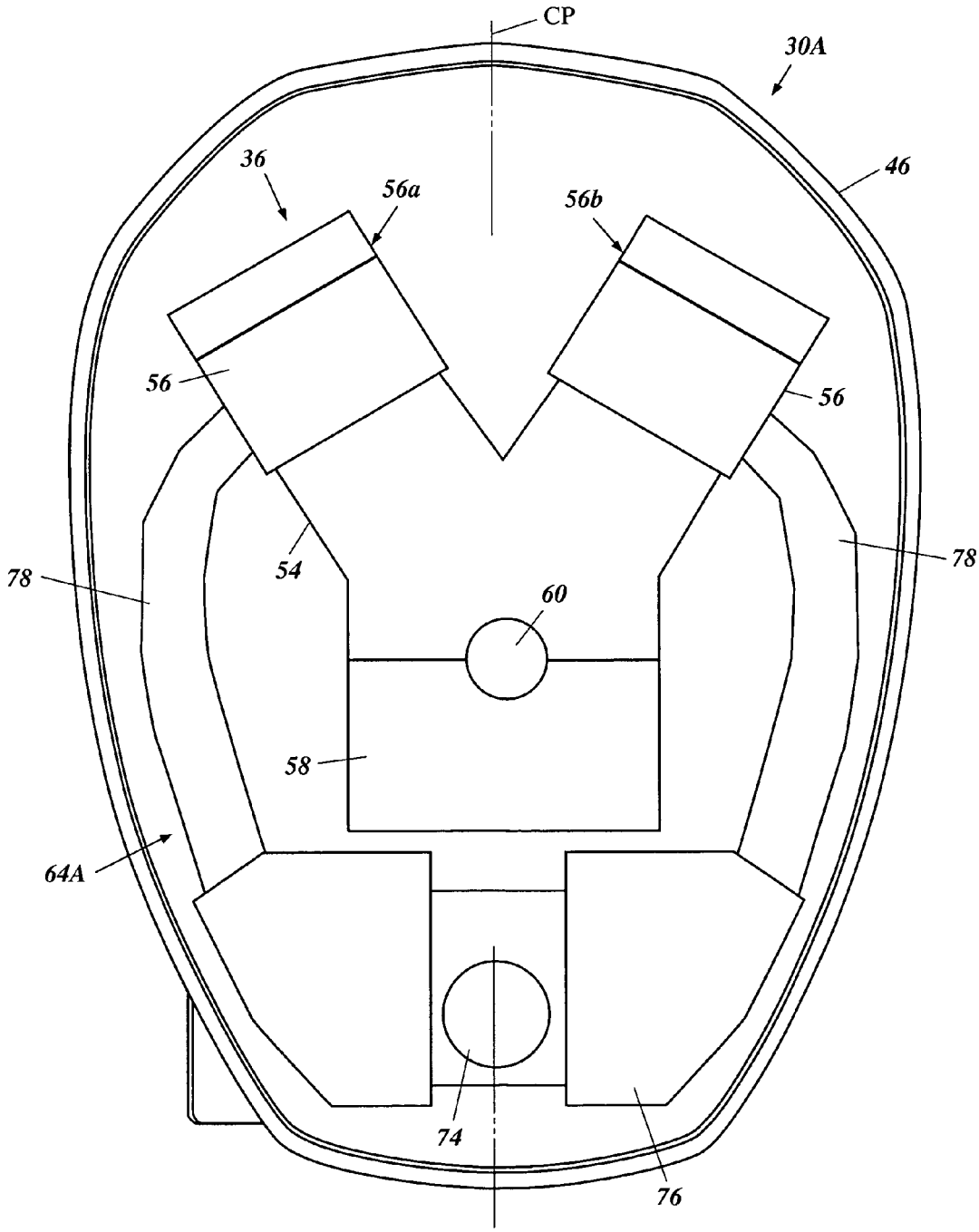
FIG. 5 schematically illustrates a top plan view of another outboard motor modified in accordance with certain features, aspects and advantages of the present invention, a top cowling of the outboard motor being removed.

Preferably, both sides of the rear wall portion 102 are directed slightly forwardly as best shown in FIG. 3. A top end of the rear wall portion 102 can be welded to the bottom surface of the external member 44*b* or can be affixed thereto by other fixing constructions using, for example, bolts and nuts.

The top section 96 of the body 44*a* in front of the air duct 50 protrudes upward to form a raised portion 106. The raised portion 106 is generally shaped as a reversed saucer with its front part gradually lowered and tapered forwardly in the top plan view. A compartment 108 for the flywheel assembly 90 is defined under the raised portion 106. The flywheel assembly 90 is accommodated within the compartment 108.

A plurality of projections or cooling fins 110 preferably extend generally upward atop the raised portion 106. The bottom surface of the external member 44*b* is higher enough so that each top end of the projections 110 does not reach the bottom surface. The illustrated projections 110 are arranged in a coaxial double circle pattern as best seen in the top plan view of FIG. 3. An axis of the double circles preferably is consistent with the axis of the crankshaft 60 and is disposed on the center plane CP. Preferably, the projections 110 are unitarily formed with the body 44*a* in the die-cast molding process. More preferably, a part of the nonferrous metal that has overflowed from the body 44*a* in the molding process forms the projections 110. The overflow portions are necessarily provided to remove the air existing in the nonferrous metal. By using the overflow portions, no specific mold for the projections is necessary. Thus, the more preferable manner can contribute to reducing manufacturing cost of the top cowling 44.

In the illustrated embodiment, the body 44*a* and the external member 44*b* together define a front air inlet port 114 such that the atmospheric air can enter the airflow space 97 also through the front inlet port 114. Preferably, a partition 116 divides the airflow space 97 into a rear airflow space 97*a* and a front airflow space 97*b*. The partition 116 generally extends transversely over the raised portion 106 through a center of the double circles of the projections 110. In the illustrated embodiment, one half of the projections 110 exist in the rear airflow space 97*a*, while the rest of the projections 106 exist in the front airflow space 97*b*. Respective side portions of the partition 116 generally extend rearward and end generally on both sides of the rear air inlet port 48. Side members 118 preferably are branched off from respective rear portions of the partition 116 toward the rear inlet port 48. The partition 116 and the side members 118 preferably are unitarily formed with the top section 96 of the cowling body 44*a*. The partition 116 can be welded to the bottom surface of the external member 44*b* or can be affixed thereto by other fixing constructions using, for example, bolts and nuts.

The illustrated partition 116 completely separate the rear and front airflow spaces 97*a*, 97*b* from each other. A pair of outlet ports 120 are defined between the body 44*a* and the external member 44*b* generally in the rear area of the top cowling 44. Preferably, each outlet port 120 is formed next to each rear end of the partition 116. As thus constructed, the entire air entering the rear airflow space 97*a* through the rear inlet port 48 is drawn into the cavity 40, while the entire air entering the front airflow space 97*b* through the front inlet port 114 goes out through either one of the outlet ports 120.

In the illustrated embodiment, other projections or cooling fins 124 preferably extend generally upward from a portion of the top section 96 of the body 44*a* that corresponds to the front airflow space 97*b*. In other words, the projections 124 are arranged along both sides of the hill portion 106 and also on each side of the partition 116 as best shown in FIG. 3. Preferably, the projections 124 also are unitarily formed with the body 44*a* in the die-cast molding process. More preferably, a part of the nonferrous metal that has overflowed from the body 44*a* in the molding process forms the projections 124 similarly to the projections 110.

Figure 2:
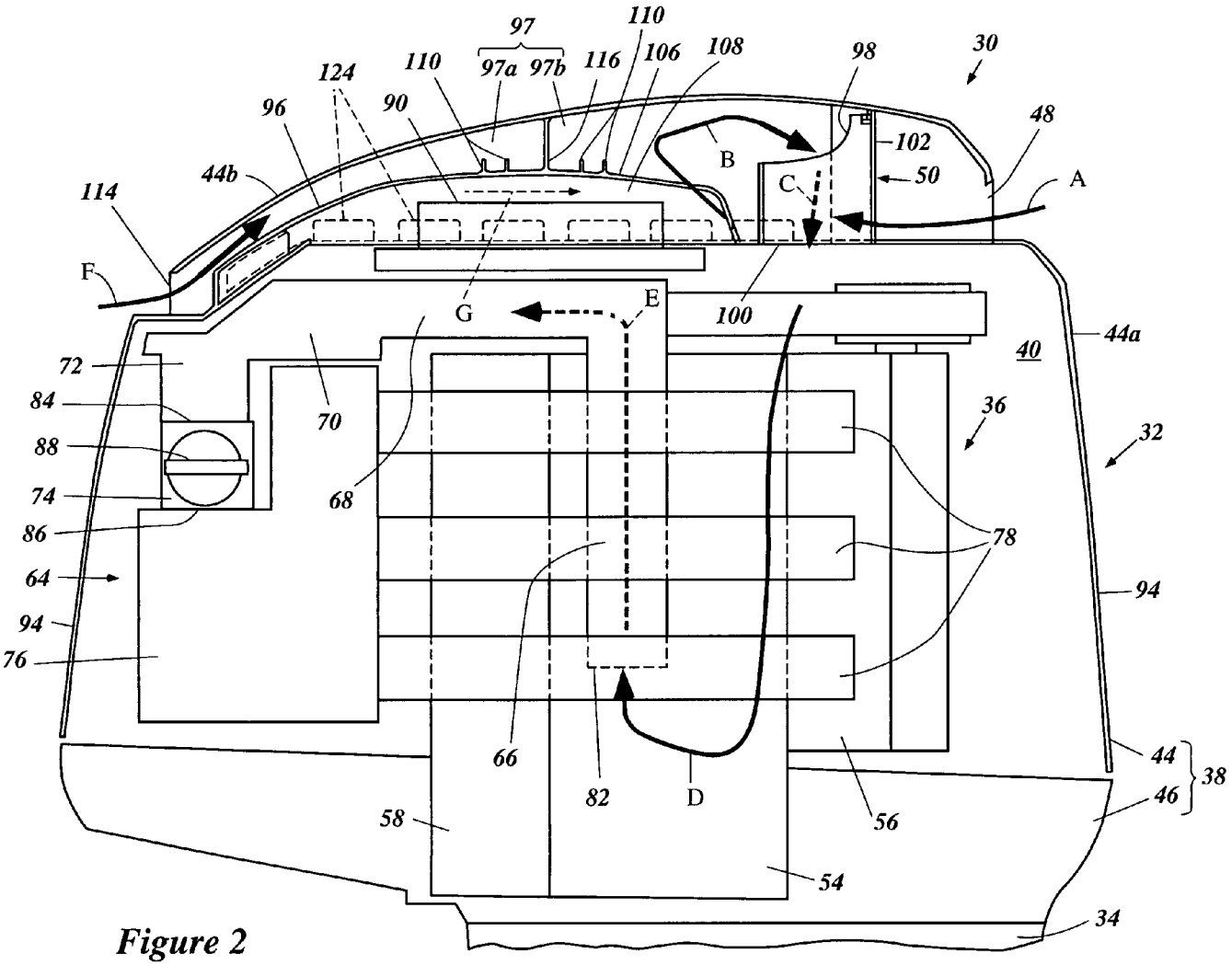
FIG. 2 schematically illustrates a side elevation and cross-sectional view of a top part of the outboard motor of FIG. 1.

As thus arranged, the top cowling 44 is generally symmetrical relative to the center plane CP as shown in FIGS. 2 and 3.

With reference to FIGS. 2 and 3, when the engine 36 operates, negative pressure that draws air is produced. The atmospheric air enters the rear airflow space 97*b* through the rear air inlet port 48 as indicated by the arrows A. The rear wall portion 102 blocks the air from going straight and therefore water that enters with the air can be separated from the air. The side members 118 and the side sections of the rear wall portion 102 guide the air to proceed forwardly on both sides of the air duct 50. The air turns toward the air duct 102 as indicated by the arrows B. Then, the air is drawn into the cavity 40 through the air duct 50 as indicated by the arrows C.

The air entering the cavity 40 descends to the inlet opening 82 that is located at the bottom of the vertical air delivery duct 66 along a side surface of the engine 36 as indicated by the arrow D of FIG. 2. On the way down to the inlet opening 82, water in the air, if any, is again separated and goes down to the bottom cowling 46. The air that does not contain water then ascends through the vertical air delivery duct 66 and then goes forward to the air silencer 70 through the horizontal air delivery duct 68. The air silencer 70 reduces the intake noise.

The air is delivered to the throttle body 74 through the connecting conduit 72. The throttle valve 88 in the throttle body 74 measures the air in accordance with its position or open degree thereof and allows the measured amount of the air to go to the plenum chamber of the plenum chamber member 76, which smoothes the air. The air, then, is branched off to the respective intake conduits 78 and is drawn to the combustion chambers of the engine 36 through the external intake passages defined by the intake conduits 78 and the internal intake passages defined by the respective cylinder heads 56 of the banks 56*a*, 56*b*.

On the other hand, when the associated watercraft proceeds forwardly with the engine 36 powering the propeller of the outboard motor 30, other atmospheric air enters the front airflow space 97*a* through the front air inlet port 114 as indicated by the arrows F.

The major part of the air travels to the outlet ports 120 as indicated by the arrows G. Remaining air goes straight toward the partition 116 as indicated by the arrows H and is blocked by the partition 116 and then merges with the air that directly travels toward the outlet ports 120.

The engine 36 can produce heat. The heat is likely to warm the air in the cavity 40 and further to warm the body 44*a* of the top cowling 44 that defines the cavity 40. The warmed air is likely to accumulate in an upper area of the cavity 40. Thus, the upper part of the cowling body 44*a* can be warmer than the lower part of the cowling body 44*a*.

The top cowling 44 that is made of the nonferrous metal can radiate the heat efficiently. The air flowing through the front airflow space 97*b* expedites the heat radiation from the top section 106 of the cowling body 44*a*. Because the nonferrous metal also has the good heat conductivity, the heat in the portion of the cowling body 44*a* corresponding to the rear airflow space 97*a* can move to the portion of the cowling body 44*a* corresponding to the front airflow space 97*b* and is then removed. In addition, the air heading to the outlet ports 120 passes by the projections 124, and the air heading toward the partition 116 passes by the half of the projections 110 disposed in the front airflow space 97*b*. The heat can be more efficiently removed because the projections 110, 124 substantially expand the front airflow space 97*b*. The partition 116 also is useful to remove the heat because the partition 116 can act as a cooling projection also.

The air flowing through the rear airflow space 97*b* can keep cool even though the air touches the cowling body 44*a*. This is because the cowling body 44*a* is cool enough as discussed above. In addition, the air to the combustion chambers is drawn from the lower area of the cavity 40. Because the air in this area is cooler than the air in the upper area of the cavity 40 as discussed above, the engine 36 can always maintain a high charging efficiency.

Additionally, the projections 110 in the rear airflow space 97*b* can contribute to removing the heat. In one variation, all of the double circled projections 110 can exist in the front airflow space 97*b*. In another variation, the raised portion 106 in the area of the front airflow space 97*b* can have more cooling projections 110. It should be noted that numbers, configurations and arrangements of the projections 110, 124 can vary.

When the outboard motor 30 proceeds in a rearward direction, the atmospheric air enters the outlet ports 120 and goes out from the inlet port 114. The air flows through the front airflow space 97*b* in the reversed direction under this condition. However, the air removes the heat in the same manners as those discussed above.

The cowling 44 thus constructed in the illustrated embodiment can provide plenty of advantages as follows.

Because the cowling assembly 38, particularly, the top cowling 44 is made of nonferrous metal, the heat in the cowling assembly 38 can be efficiently radiated. Thus, relatively cool air can be supplied to the engine 36 even though the atmospheric air passes through the cavity 40 of the top cowling 44. In addition, the nonferrous metal is lighter than iron or iron alloy.

The die-casting process can efficiently produce the cowling assembly 38 that is extremely precise.

The water entering through the rear air inlet port 48 is removed while the air detours forwardly before drawn into the air duct 50 and also while the air descends before entering the vertical air delivery duct 66. The air having no water thus can be drawn into the combustion chambers.

The front airflow space 97*b* divided by the partition 116 from the rear airflow space 97*a* is useful to cool the cowling body 44*a* because the air passing therethrough can efficiently remove the heat of the cowling body 44*a*. In addition, the air is introduced into the front airflow space 97*b* by aerodynamic force without the use of a fan or air moving system. Further, the entire air, which can contain much water, is discharged through the outlet ports 120. Therefore, the combustion chambers do not draw the air containing water.

The projections 110, 124 contribute to increasing the heat radiation effect. In addition, the projections 110, 124 are formed with the part of the material overflowed from the body 44*a* in the molding process. Therefore, the manufacturing cost thus can be reduced.

Because the vertical air delivery duct 66 can draw the air in the lower part of the cavity 40, which is relatively cool, the temperature of the air to the combustion chambers can be held at a lower level. Therefore, the charging efficiency of the engine 36 can maintain high.

With reference to FIGS. 5–8, another outboard motor 30A modified in accordance with certain features, aspects and advantages of the present invention is described below. In general, the devices, components, members and portions thereof that have been described above are assigned with the same reference numerals or symbols and are not described repeatedly. Also, modified devices, components, members and portions thereof are assigned with the same reference numerals or symbols that are followed by the letter "A" and are not described in detail.

The outboard motor 30A has a top cowling 44A modified from the top cowling 44. The foregoing external member 44*b* is unitarily formed with a body 44*a*A in the illustrated embodiment. Instead, an internal member 44*b*A is separately prepared and is disposed under a top section 96A. Thus, the internal member 44*b*A has a configuration similar to the configuration of the foregoing top section 96, and the top section 96A has a configuration similar to the configuration of the foregoing external member 44*b*. Because the internal member 44*b*A extends below the top section 96A of the body 44*a*A, the internal member 44*b*A forms an internal wall portion and the top section 96 of the body 44*a* forms an external wall portion in this embodiment.

Like the external member 44*b*, the internal member 44*b*A can be made of a nonferrous metal that is the same nonferrous metal as the body 44*a*A or is a different nonferrous metal. Otherwise, the internal member 44*b*A can be made of another kind of metal or a plastic material.

The internal member 44*b*A comprises an air duct 50 that has the same configuration as the foregoing air duct 50 and a raised portion 106A that is similar to the foregoing raised portion 106. A rear air inlet port 48A is defined between a rear end of the internal member 44*b*A and a rear end of the top section 96A of the cowling body 44*a*A. The inlet port 48A is slightly larger than the foregoing inlet port 48 because the port 48A opens wider.

An airflow space 97A preferably is defined between a bottom surface of the top section 96A and a top surface of the internal member 106A. A partition 116A preferably divides the airflow space 97A into a rear airflow space 97*a*A and a front airflow space 97*h*A in a slightly different way from the foregoing partition 116. The partition 116A in this embodiment extends generally transversely between both side ends of the top cowling 44A and slightly in the rear of the crankshaft axis. The partition 116A preferably is unitarily formed with the internal member 44*b*A.

The front airflow space 97*b*A has no air inlet port nor air outlet port, which communicates with an external location of the top cowling 44A. The internal member 44*b*A preferably has a pair of inlet ducts 130 extending generally vertically on both sides of the front airflow space 97*b*A. Preferably, each inlet duct 130 is placed generally at a corner where the partition 116A intersects a side surface of the cowling body 44*a*A. Also, a bottom opening 131 of each inlet duct 130 preferably is positioned higher than the outlet opening 100 of the air duct 50. The internal member 44*b*A also has an outlet duct 132 extending generally vertically on the center plane CP. The inlet and outlet ducts 130, 132 preferably are unitarily formed with the internal member 44*b*A.

A pair of baffles 134 extend generally vertically on both sides of the outlet duct 132. The baffles 134 also extend generally rearwardly toward the partition 116A from a front end of the internal member 44*b*A to form a space between the partition 116A and respective tip portions of the baffles 134. Another pair of baffles 136 extend generally vertically on respective inner sides (i.e., the sides that faces the center plane CP) of the inlet ducts 130. The baffles 136 also extend generally forwardly toward the front end of the internal member 44*b*A from the partition 16A to form spaces between the front end of the internal member 44*b*A and respective tip portions of the baffles 136. Preferably, each tip portion of the baffle 136 turns inwardly forwardly toward the baffle 134 on the same side. Both of the baffles 134 preferably are unitarily formed with the internal member 44*b*A and reach the bottom surface of the top section 96A of the cowling body 44*a*A. The baffles 134, 136 together form air passages through which the inlet ducts 130 communicate with the outlet duct 132. The baffles 134, 136, however, compel the air to bypass the baffles 134, 136 while flowing through the air passages.

A plurality of projections or cooling fins 124A are disposed in the air passages. The projections 124A in this embodiment depend from the bottom surface of the top section 96A of the cowling body 44*a*A toward the top surface of the internal member 44*b*A. The projections 124A are unitarily formed with the cowling body 44*a*A. Bottom ends of the respective projections 24A are spaced apart from the internal member 44*b*A.

Figure 7:
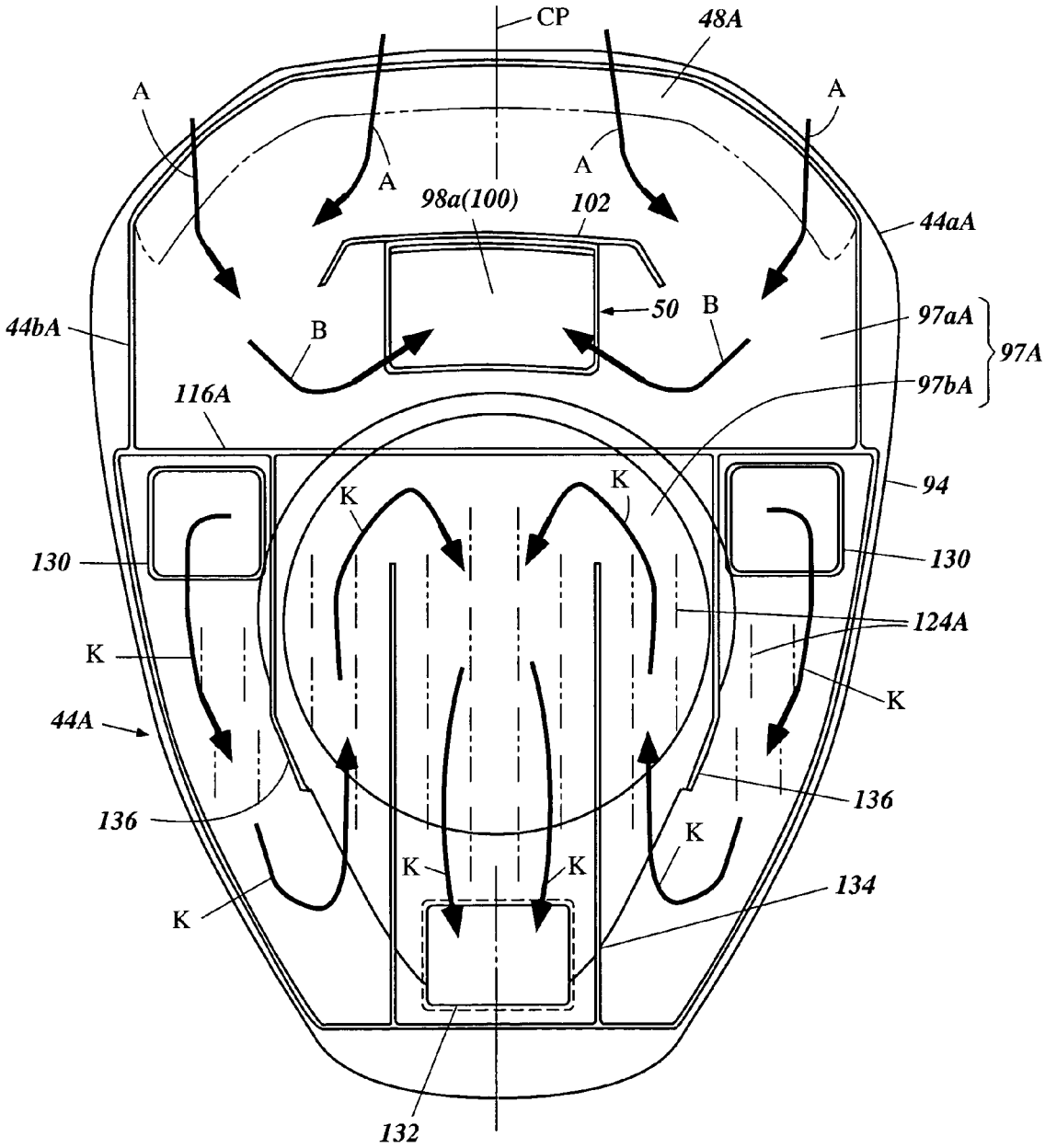
FIG. 7 schematically illustrates a top plan and cross-sectional view of the top cowling which is modified.
Figure 8:
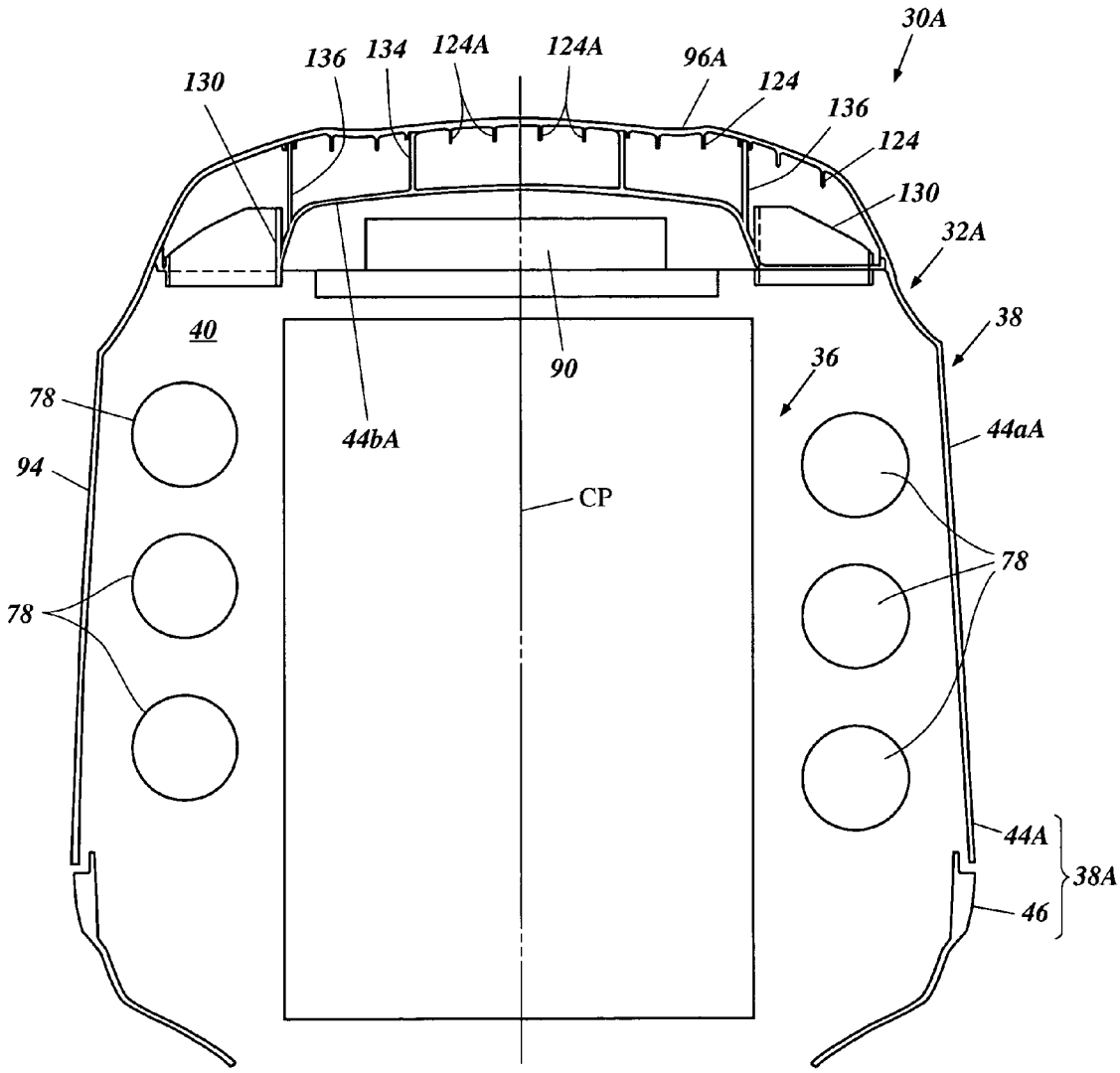
FIG. 8 schematically illustrates a front elevation and cross-sectional view of the top part of the outboard motor of FIG. 5.

As thus arranged, like the foregoing top cowling 44, the top cowling 44A is generally symmetrical relative to the center plane CP as shown in FIGS. 7 and 8.

The internal member 44*b*A preferably is fixed to the cowling body 44*a*A by welding or other proper fastening systems using, for example, bolts and nuts. The rear wall portion 102 of the air duct 50 and the partition 116A also are welded to the bottom surface of the top section 96A of the cowling body 44*a*A or fixed thereto by the fixing constructions.

An air intake system 64A in the illustrated embodiment does not comprise the foregoing vertical and horizontal delivery ducts 66, 68. The front airflow space 97*b*A replaces those ducts 66, 68 and defines an air passage through which the closed cavity 40 communicates with an air silencer 70A. The air silencer 70A in this embodiment has an inlet opening 140 that opens upward. A bottom end or coupling end of the outlet duct 132 can be coupled to the inlet opening 140 when the top cowling 44A is attached to the bottom cowling 46. An elastic seal such as, for example, a rubber seal 144 is interposed between the coupling end of the outlet duct 132 and the silencer 70A such that the rubber seal 144 is pressed therebetween when the top cowling 44A is attached to the bottom cowling 46 in the vertical direction. As thus arranged, the rubber seal 144 can seal tightly whenever the top cowling 44A is joined to the bottom cowling 46.

Figure 6:
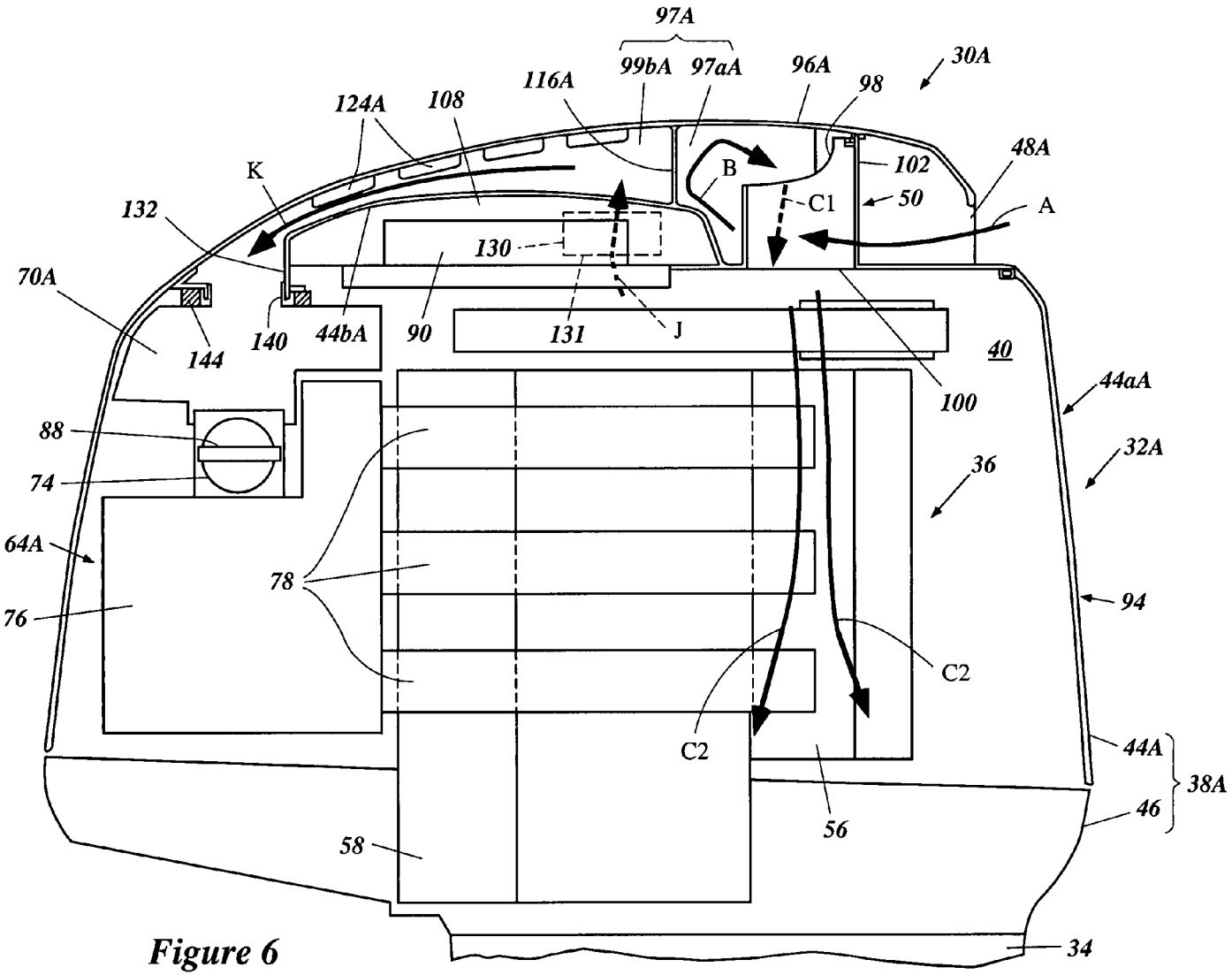
FIG. 6 schematically illustrates a side elevation and cross-sectional view of a top part of the outboard motor of FIG. 5.

With reference to FIGS. 6 and 7, when the engine 36 operates, the atmospheric air enters the rear airflow space 97*b*A through the rear air inlet port 48 as indicated by the arrows A and then enters the air duct 50 as indicated by the arrows B. The air passes through the air duct 50 and flows into the cavity 40 as indicated by the arrows C1 and C2. Those flows A, B, C1 and C2 of the air are similar to the foregoing flows A, B, and C in the first embodiment.

The air in this embodiment then ascends to the front airflow space 97*b*A through the inlet ducts 130 as indicated by the arrows J of FIG. 6. The air flows along the baffles 136, 134 forwardly and backwardly within the front airflow space 97*b*A and reaches the outlet port 132 as indicated by the arrows K. The air then is drawn into the silencer 70A.

The top section 96A in this embodiment is exposed to the external air. When the outboard motor 30A is in motion, the external air efficiently removes the heat in the top section 96A as well as the side sections 94. The air in the front airflow space 97*b*A thus can be extremely cooled while traveling through the relatively long passage defined by the baffles 136, 134. The projections 124A expedite the cooling effect. The air drawn to the combustion chambers is cool enough to keep the charging efficiency high.

In this embodiment, the air descends through the air duct 50 and then ascends through the inlet ducts 130. In addition, the air bypasses the baffles 134,136. Further, the bottom opening 131 of each inlet duct 130 is positioned higher than the outlet opening 100 of the air duct 50 in this embodiment. No chance exists for the water coming from the air duct 50 to enter to the inlet ducts 130. The water in the air thus can be removed before entering the silencer 70A. Additionally, the rubber seal 144 can be tightly set to the position to inhibit the water in the cavity 40, if any, from entering the silencer 70A only by the top cowling 44*a*A attached to the bottom cowling 46.

Although the present inventions have been disclosed in the context of certain preferred embodiments, it will be understood by those skilled in the art that the present inventions extend beyond the specifically disclosed embodiments to other alternative embodiments and/or uses of the inventions and obvious modifications and equivalents thereof. In addition, modifications, which are within the scope of these inventions, will be readily apparent to those of skill in the art based upon this disclosure. It is also contemplated that various combination or sub-combinations of the specific features and aspects of the disclosed embodiments or variations may be made and still fall within the scope of the invention. It should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above, but should be determined only by a fair reading of the claims.

What is claimed is:

1. An outboard motor comprising a housing unit adapted to be mounted on an associated watercraft, an internal combustion engine disposed on the housing unit, and a cowling surrounding the engine the cowling having a first inlet port through which atmospheric air outside of the outboard motor enters inside of the cowling, a second inlet port through which atmospheric air outside of the outboard motor enters the inside of the cowling, at least one outlet port through which a substantial portion of said atmospheric air from the second inlet port exits to an external location of the cowling, and a partition that separates the air that has entered through the second inlet port from the air entering through the first inlet port, the cowling substantially being made of a nonferrous metal.

2. The outboard motor as set forth in claim 1, wherein the cowling comprises a bottom cowling member and atop cowling member, the bottom cowling member generally extends about a lower portion of the engine, the top cowling member surrounds the engine above the bottom cowling member, and a substantial part of the top cowling member is made of the nonferrous metal.

3. The outboard motor as set forth in claim 1, wherein the nonferrous metal includes aluminum or magnesium as a component thereof.

4. The outboard motor as set forth in claim 1, wherein the cowling comprises an external wall portion and an internal wall portion together defining an airflow space, and at least one of the external wall portion and the internal wall portions has at least one projection extending into the airflow space.

5. The outboard motor as set forth in claim 4, wherein one of the external wall portion or the internal wall portion is a part of a body of die cowling, the other of the external or internal wall portion is a separate member that is attached to the body, and the projection extends from the external or internal wall portion that forms part of the body.

6. The outboard motor as set forth in claim 5, wherein the body of the cowling is formed in a molding process, and the projection is part of the nonferrous metal that has overflowed from the body in the molding process.

7. The outboard motor as set forth in claim 6, wherein the body of the cowling is a die cast piece.

8. The outboard motor as set forth in claim 4, wherein the air entering through the first inlet port communicates with the engine through the airflow space.

9. The outboard motor as set forth in claim 8, wherein the cowling has a baffle that directs the air in the airflow space.

10. The outboard motor as set forth in claim 4, wherein the airflow space is positioned generally atop the cowling.

11. The outboard motor as set forth in claim 1, wherein the cowling comprises a first duct through which the air generally descends, and a second duct through which the air generally ascends, the air is drawn into the engine after passing through the first and second ducts.

12. The outboard motor as set forth in claim 1, wherein the second inlet port is formed at a front end portion of the cowling, the outlet port is formed at a rear end portion of the cowling.

13. The outboard motor as set forth in claim 1, further comprising an atmospheric air passageway extending between the second inlet port and the outlet port such that external atmospheric air enters the second inlet port, passes through the atmospheric air passageway, and is passed out of the outlet port to the external location.

14. The outboard motor as set forth in claim 1, wherein the first inlet port and the second inlet port arc at opposite ends of the outboard motor.

15. The outboard motor as set forth in claim 14, further comprising a longitudinal passageway extending between the second inlet port and pair of outlet ports.

16. The outboard motor as set forth in claim 15, wherein the first inlet port is positioned between the outlet ports.

17. An outboard motor comprising a housing unit adapted to be mounted on an associated watercraft, an internal combustion engine disposed on the housing unit, and a cowling surrounding the engine, the cowling having a first inlet port through which atmospheric air outside the outboard motor enters inside of the cowling, the cowling substantially being made of a nonferrous metal, the cowling comprises an external wall portion and an internal wall portion together defining an airflow space, and at least one of the external wall portion and the internal wall portions has at least one projection extending into the airflow space, the cowling additionally comprises a partition dividing the airflow space into at least first and second airflow spaces, the first airflow space communicates with the first inlet port, the second airflow space has a second inlet port and an outlet port, atmospheric air outside tie outboard motor enters the second airflow space through the second inlet port and a substantial portion of said atmospheric air from said second inlet port exits to an external location of the cowling through the outlet port.

18. An outboard motor comprising a housing unit adapted to be mounted on an associated watercraft, an internal combustion engine disposed on the housing unit, and a cowling surrounding the engine, the cowling having a first inlet port through which atmospheric air enters inside of the cowling, the cowling substantially being made of a nonferrous metal, the cowling comprises an external wall portion and an internal wall portion together defining an airflow space, at least one of the external wall portion and the Internal wall portions has at least one projection extending into the airflow space, the air entering through the first inlet port communicates with the engine through the airflow space, the cowling defines a cavity below the airflow space that is sized to accommodate the engine, the cowling additionally comprises a partition dividing the airflow space into at least first and second airflow spaces, the second airflow space communicates with the engine, the external or internal wall portion has a first duct through which the first airflow space communicates with the cavity, and a second duct comprising a bottom opening and an upper opening positioned higher than the bottom opening, an elongated body of the second duct extending between the bottom opening and the upper opening and through which the cavity communicates with the second airflow space, the bottom opening of the second duct is positioned higher than a bottom opening of the first duct, a flow path for intake air flow, the flow path extends from the first airflow space, through the first duct, through the cavity, and then extends through the second duct into the second airflow space such that air in the second airflow space is drawn into the engine for combustion.

19. The outboard motor as set forth in claim 18, wherein the internal wall portion comprises substantially a nonferrous material.

20. The outboard motor as set forth in claim 18, wherein the first duct extends downwardly from the first airflow space into the cavity and terminates at the bottom opening of the first duct, the bottom opening of the first duct is positioned in the cavity, the elongated body of the second duct extends upwardly between the bottom opening of the second duct and the upper opening of the second duct.

21. An outboard motor comprising an internal combustion engine and a cowling surrounding the engine, the cowling comprising an external wall portion and an internal wall portion together defining an airflow space through which atmospheric air flows, at least one of the external and internal wall portions having at least one cooling fin projecting into the airflow space, the cowling having a first inlet port through which atmospheric air outside of the outboard motor enters inside of the cowling, the cowling comprises a second inlet port through which atmospheric air outside of the outboard motor enters the inside of the cowling, an outlet port through which a substantial portion of said atmospheric air from the second inlet port exits to an external location of the cowling, and a partition that separates the air that has entered through the second inlet port from the air entering through the first inlet port.

22. The outboard motor as set forth in claim 21, wherein one of the external or internal wall portions forms part of a body of the cowling, the other one of the external or internal wall portions is a separate member that is attached to the body, and the cooling fin extends from the external or internal wall portion that forms part of the body.

23. An outboard motor comprising an internal combustion engine, and a cowling surrounding the engine, the cowling comprising atop cowling member and a bottom cowling member, the engine being disposed primarily above the bottom cowling member, the top cowling member detachably affixed to the bottom cowling member, the engine having an air intake device, the cowling comprising an external wall portion and an internal wall portion together defining an airflow space through which air flows, the airflow space being coupled to the air intake device when the top cowling member is attached to the bottom cowling member, the cowling defines a cavity that is sized to accommodate the engine, the cowling comprises a partition dividing the airflow space into at least first and second airflow spaces, the external or internal wall portion has a first duct through which the first airflow space communicates with the cavity, and a second duet comprising a bottom opening and an upper opening being positioned higher than the bottom opening, an elongated body of the second duct extending between the bottom opening and the upper opening and through which the cavity communicates with the second airflow space, the bottom opening of the second duct is positioned higher than a bottom opening of the first duct, a flow path for intake air flow, the flow path extends from the first airflow space, through the first duct, through the cavity, and then extends through the second duct Into the second airflow space such that air in the second airflow space is drawn into the engine for combustion.

24. The outboard motor as set forth in claim 23, wherein at least one of the external and the internal wall portions has a coupling end which the air intake device is coupled.

25. The outboard motor as set forth in claim 24 additionally comprising a seal member interposed between the coupling end and the intake device when the top cowling member is attached to the bottom cowling member.

26. A cowling for an outboard motor having an internal combustion engine comprising a body that is adapted to surround the engine, the body having an opening through which the engine is capable to pass, the body being made of a nonferrous metal, the body having a first inlet port through which atmospheric air outside of the outboard motor enters inside of the body, a second inlet port through which atmospheric air outside of the outboard motor enters the inside of the body, an outlet port through which a substantial portion of said atmospheric air from the second inlet port exits to an external location of the body, and a partition that separates the air that has entered through the first inlet port and air flowing to the outlet port.

27. The cowling as set forth in claim 26 additionally comprising a member attached to the body, the member and the body defining together an airflow space.

28. The cowling as set forth in claim 26, wherein at least one cooling projection extends from the body into the airflow space.

29. The cowling as set forth in claim 28, wherein the body is a molded component formed in a molding process, and the at least one cooling projection is part of the nonferrous metal that has overflowed from the body in the molding process.

* * * * *

UNITED STATES PATENT AND TRADEMARK OFFICE

CERTIFICATE OF CORRECTION

PATENT NO. : 7,118,432 B2
APPLICATION NO. : 10/814416
DATED : October 10, 2006
INVENTOR(S) : Goichi Katayama It is certified that error appears in the above-identified patent and that said Letters Patent is hereby corrected as shown below:

1. At column 5, line 1, please delete “flows-through” and insert therefore, -- flows through --.

2. At column 10, line 39, please delete “97hA” and insert therefore, -- 97bA --.

3. At column 12, line 39, in Claim 1, after “engine” please insert -- , --.

4. At column 12, line 51, in Claim 2, please delete “atop” and insert therefore, -- a top --.

5. At column 13, line 1, in Claim 5, please delete “die” and insert therefore, -- the --.

6. At column 13, line 17, in Claim 10, please delete “atop” and insert therefore, -- a top --.

7. At column 13, line 34, in Claim 14, please delete “arc” and insert therefore, -- are --.

8. At column 13, line 56, in Claim 17, please delete “tie” and insert therefore, -- the --.

9. At column 14, line 3, in Claim 18, please delete “Internal” and insert therefore, -- internal --.

10. At column 14, line 58, in Claim 23, please delete “atop” and insert therefore, -- a top --.

11. At column 15, line 5, in Claim 23, please delete “duet” and insert therefore, -- duct --.

UNITED STATES PATENT AND TRADEMARK OFFICE

CERTIFICATE OF CORRECTION

PATENT NO. : 7,118,432 B2
APPLICATION NO. : 10/814416
DATED : October 10, 2006
INVENTOR(S) : Goichi Katayama It is certified that error appears in the above-identified patent and that said Letters Patent is hereby corrected as shown below:

12. At column 15, line 14, in Claim 23, please delete "Into" and insert therefore, -- into --.

13. At column 15, line 19, in Claim 24, please delete "end" and insert therefore, -- at --.

Signed and Sealed this

Twenty-seventh Day of May, 2008

JON W. DUDAS
*Director of the United States Patent and Trademark Office*